US006461278B1

(12) United States Patent
Troset

(10) Patent No.: US 6,461,278 B1
(45) Date of Patent: Oct. 8, 2002

(54) TREADMILL

(76) Inventor: Per Arne Troset, Hjalmar Haalkes v. 5, N-7033 Trondheim (NO)

( * ) Notice: Subject to any disclaimer, the term of this patent is extended or adjusted under 35 U.S.C. 154(b) by 0 days.

(21) Appl. No.: 09/380,612

(22) PCT Filed: Mar. 24, 1998

(86) PCT No.: PCT/NO98/00095

§ 371 (c)(1),
(2), (4) Date: Sep. 16, 1999

(87) PCT Pub. No.: WO98/42412

PCT Pub. Date: Oct. 1, 1998

(30) Foreign Application Priority Data

Mar. 24, 1997 (NO) ..... 971391

(51) Int. Cl.[7] ..... A63B 22/02
(52) U.S. Cl. ..... 482/54; 482/51

(58) Field of Search ..... 482/51, 54, 52, 482/148, 908; 198/841, 313, 493, 861.1

(56) References Cited

U.S. PATENT DOCUMENTS

| | | | | | |
|---|---|---|---|---|---|
| 4,872,664 | A | * | 10/1989 | Parker | 272/69 |
| 5,088,729 | A | * | 2/1992 | Dalebout | 272/69 |
| 5,690,587 | A | * | 11/1997 | Gruenangerl | 482/54 |
| 6,117,053 | A | * | 9/2000 | Chiu | 482/54 |

* cited by examiner

*Primary Examiner*—Jerome W. Donnelly
*Assistant Examiner*—Tam Nguyen
(74) *Attorney, Agent, or Firm*—Dennison, Schultz & Dougherty

(57) ABSTRACT

An improved treadmill is provided having several integrated structures, mainly, a main frame and a belt module. The belt module includes a belt organ, a turn roller, and a running base, all of which are easily secured to and detached from the main frame allowing for an easy belt replacement.

11 Claims, 4 Drawing Sheets

TREADMILL

The invention concerns a treadmill according to the introductory part of claim 1.

BACKGROUND

As well known, treadmills are used mainly for running and training indoors, for example for measuring the capacity of a runner, or in situations where it is difficult for the runner to train outdoors. Traditional treadmills are constructed on a framework with a belt organ drawn out over a drive roller and a turn roller. Furthermore, the drive roller is connected to a drive means, usually in the shape of an electrical motor, through a driving wheel and belt. The treadmill can also be equipped with regulators in order to adjust the rotation speed of the belt organ, measure the distance run and adjust the height of the forward part of the mill in order to stimulate uphill running. Furthermore, the carrying structure of the framework is separated in the front of the drive roller in order to remove the side cover of the framework and provide access to the belt organ, for maintenance and changing the belt.

A disadvantage in prior art is first that a change of the belt organ is very time consuming and, in many cases, takes up to one day. Besides, the separated carrying construction involves a potential breaking point in the area where the load is greatest, that is, the area taking up weight of the drive unit and weight of the runner, and the construction can thus during a period of time be weakened in the breaking point and collapse.

OBJECT

The object with present invention is to provide an improved treadmill overcoming the disadvantages with prior art stated above.

THE INVENTION

This object is achieved with a treadmill according to the characterizing part of claim 1. Further advantageous features are provided in the independent claims.

The object of the invention is achieved by the carrying structure of the treadmill—the main frame—is formed as an integrated unit and is formed so that the belt module comprising the belt organ, the turn roller and the running base, in a quick and easy way can be pushed in and out of he main frame, for ease in changing of the belt. Another advantage achieved is that the construction, due to the unity of the main frame, does not represent any potential deflection point, as opposed to previously known devices.

Figure 1:
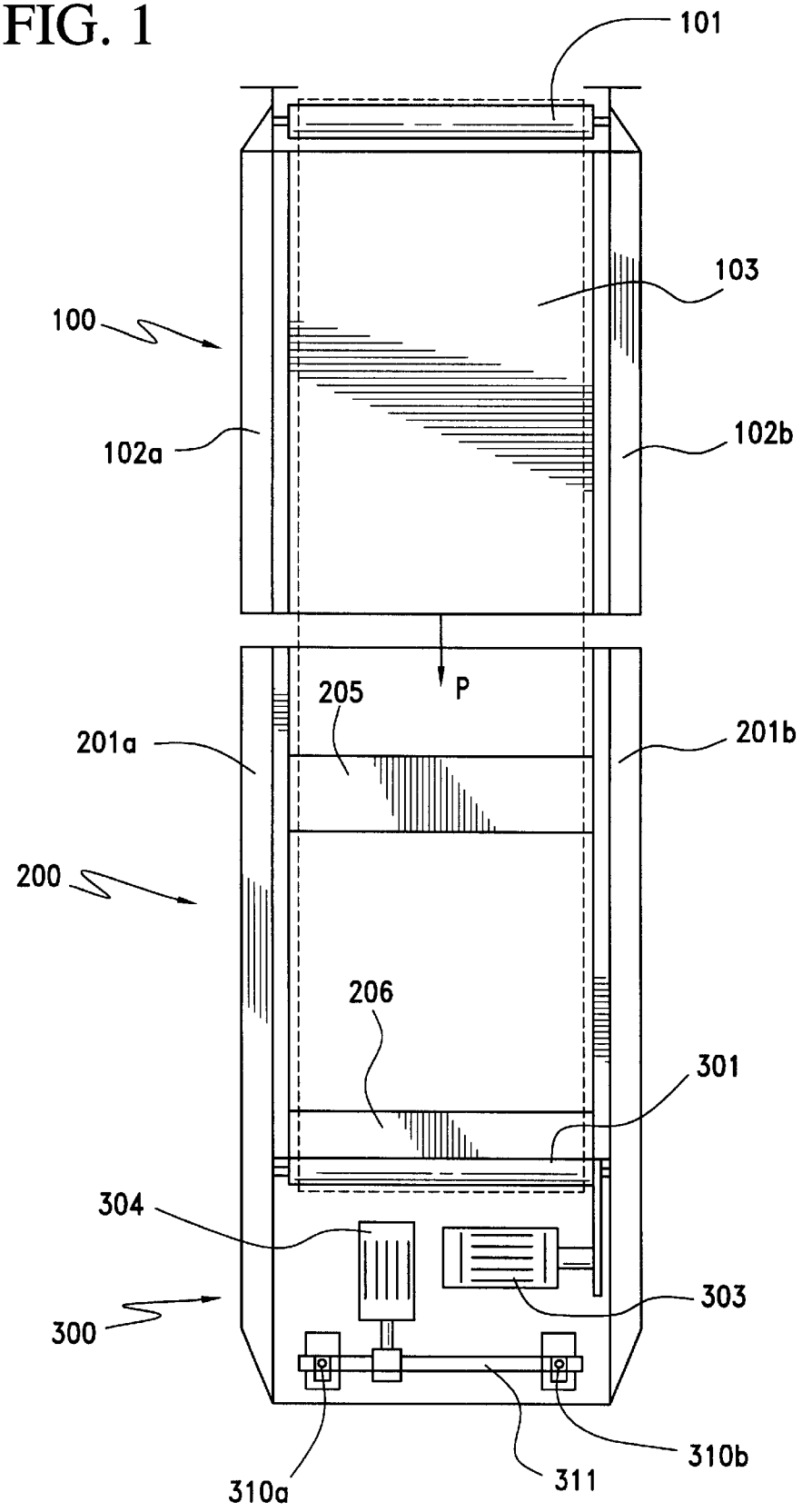
Figure 2A:
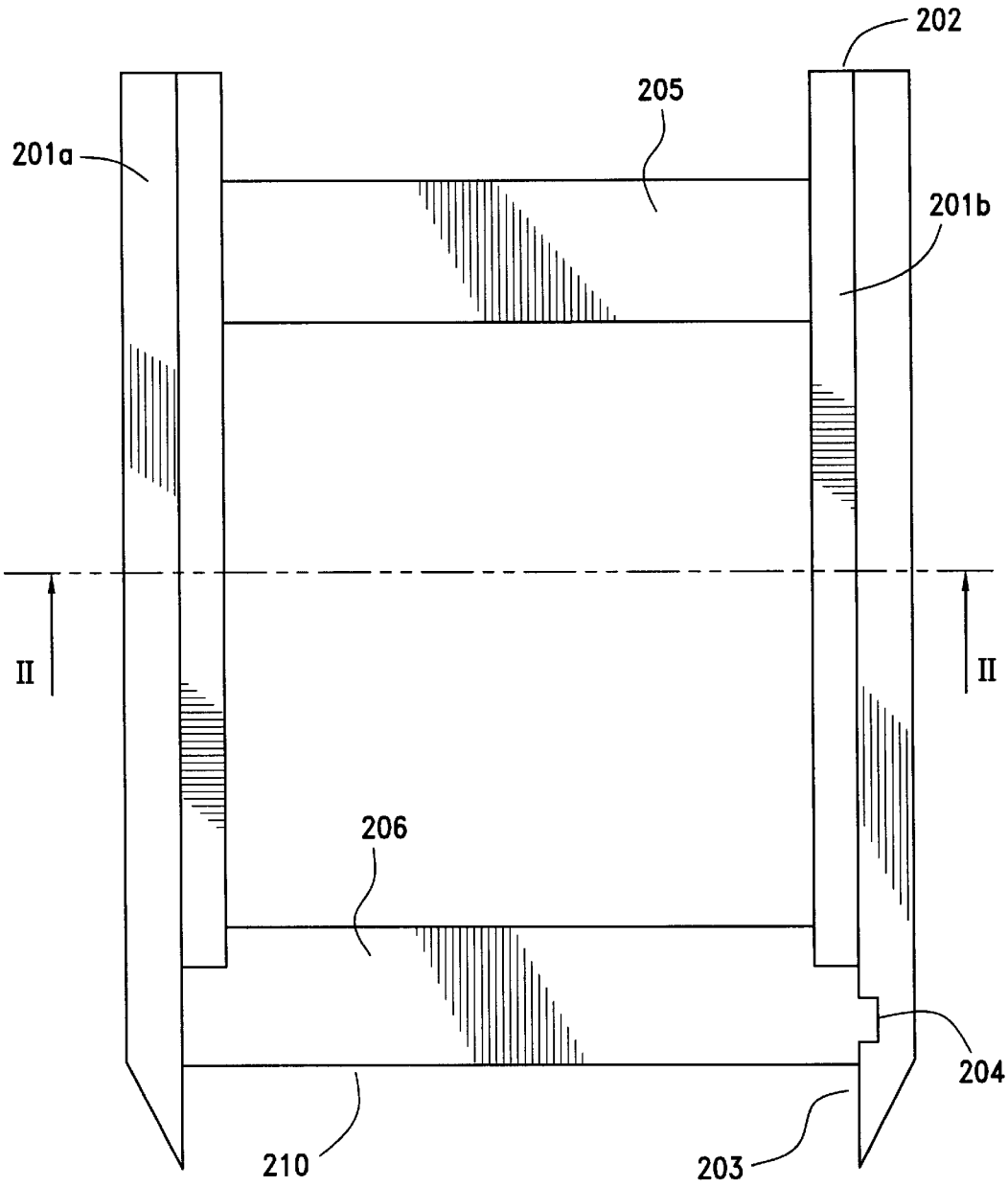
Figure 2B:
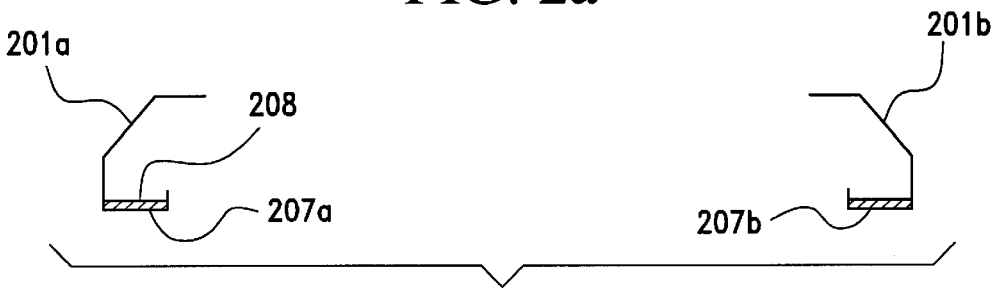
Figure 3A:
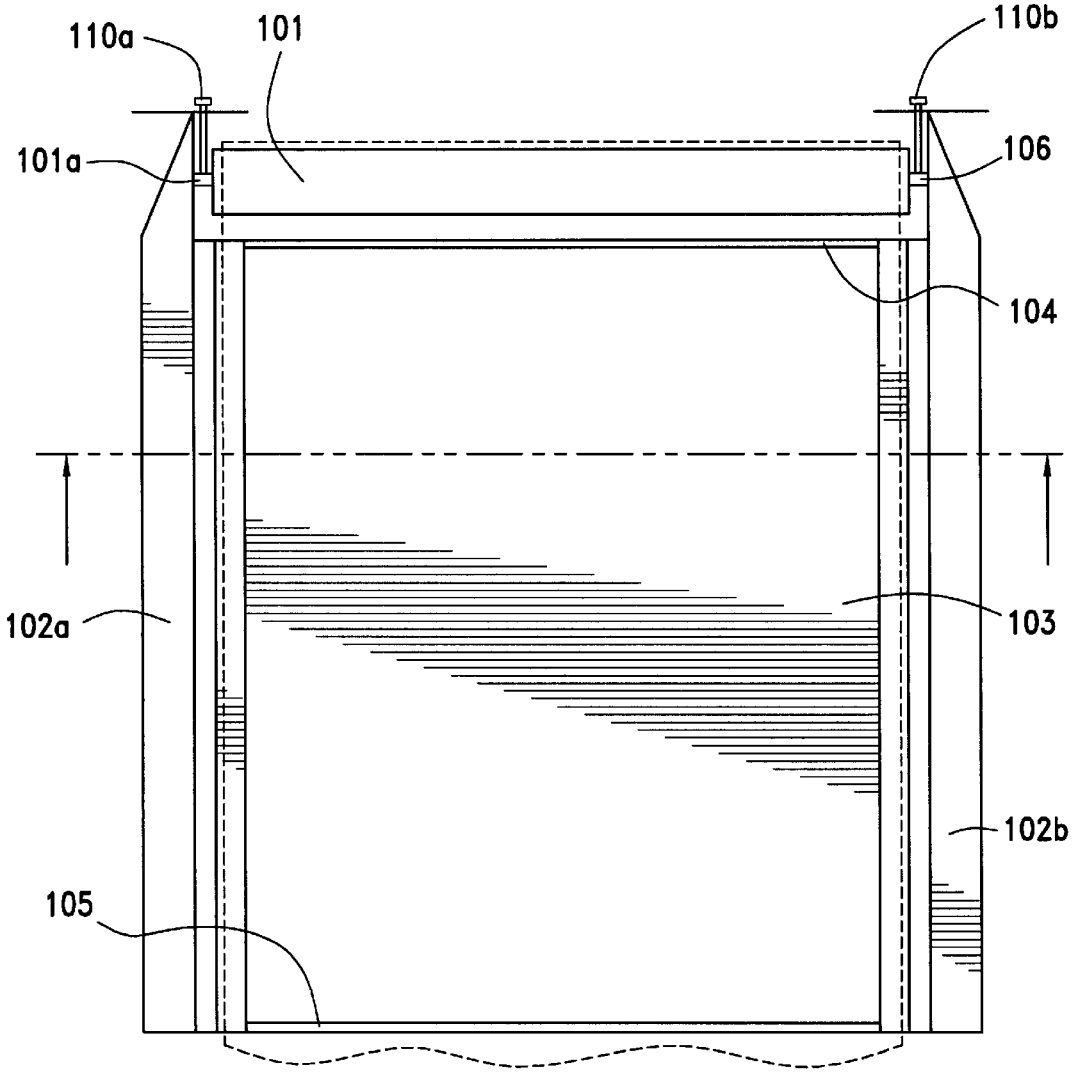
Figure 3B:
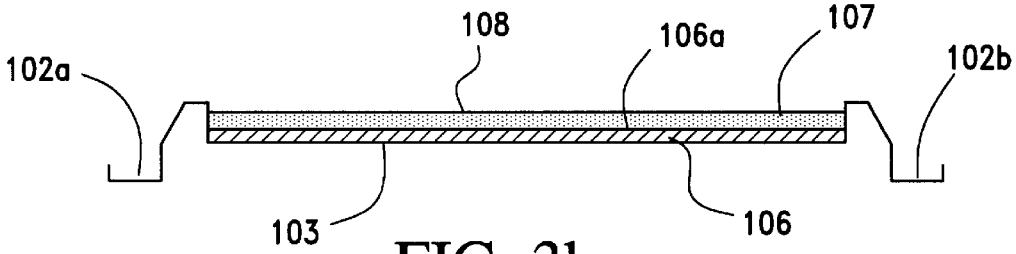
Figure 4A:
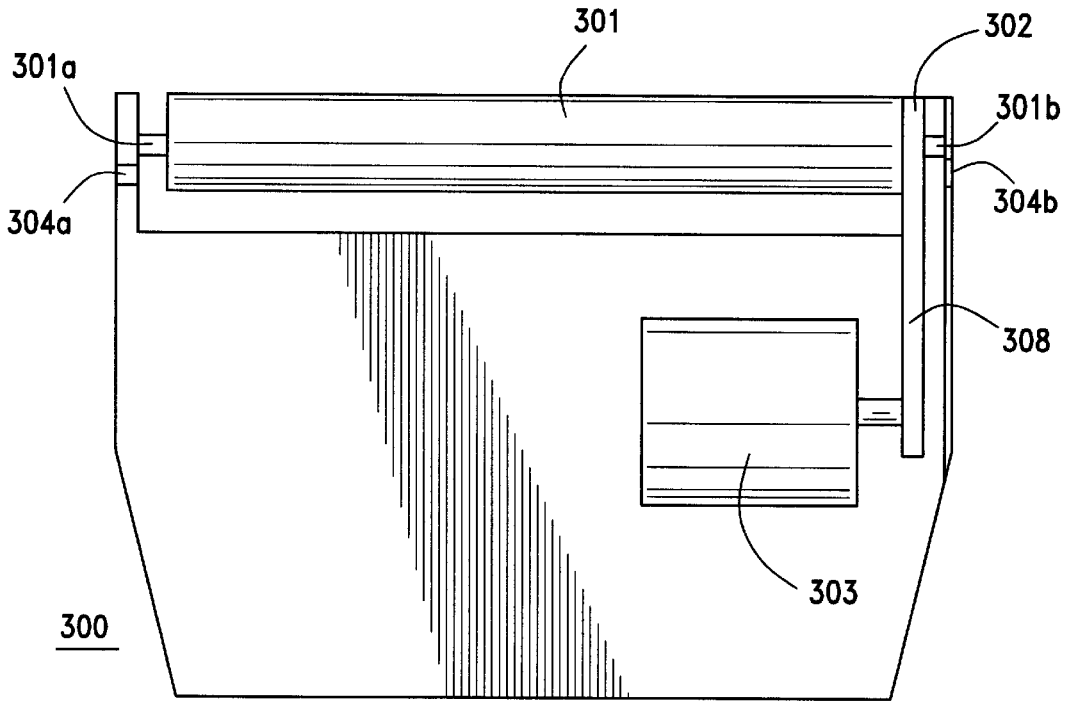
Figure 4B:
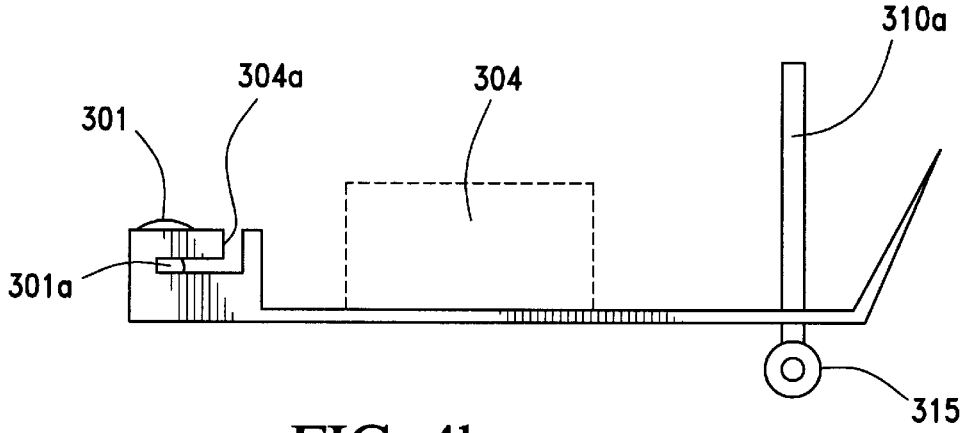

In the following, the invention will be described more in detail with reference to the drawings, where FIG. 1 shows a schematic drawing illustrating the treadmill according to the invention, viewed from above, FIG. 2*a* shows the main frame in FIG. 1, viewed from above, FIG. 2*b* shows a section through the main frame in FIG. 2*a* through the line II—II, FIG. 3*a* shows the belt module in FIG. 1, viewed from above, FIG. 3*b* shows a section through the belt module in FIG. 3*a* through the line III—III, FIG. 4*a* shows the drive unit in FIG. 1 viewed from above, and FIG. 4*b* shows the drive unit viewed from the left side of FIG. 4*a*.

FIG. 1 illustrates, strongly schematically, the treadmill according to present invention, comprising a belt module 100, a main frame 200 and a drive unit 300. The main frame 200 is illustrated fixed to the drive unit 300, while the belt module 100 is illustrated in an extended condition and without a belt. Besides, the treadmill comprises banisters, regulator, cover, displaying means, etc., which is omitted from the drawings, for simplicity.

When mounting the belt module 100, it is pushed into guide rails in the main frame 200, so that it is taken up therein.

FIG. 2*a* shows the main frame in FIG. 1 separate, viewed from above. The main frame comprises side frames 201*a*, 201*b*, and has a rear end 202 and a forward end 203. The side frames 201*a*, 201*b* are attached to each other by two or more tie bars 205, 206, in order to establish a rigid carrying structure. As is clear from FIG. 2*b*, which shows a section through the main frame following the line II—II in FIG. 2*a*, each of the side frames is provided with a low friction coating 208, in order to ease the running in and out of the belt module 100 in the main frame 200. At the forward end 203 of the main frame 200 is formed a recess 210 in order to ease the running in and of the drive roller at the drive unit 300.

FIG. 3*a* shows the belt module 100 in FIG. 1, viewed from above. The belt module comprises first and second guide rails 102*a*, 102*b*, or similar means, extending parallel and connected with an intermediate support surface 103. First and second guide rails 102*a*, 102*b* have a form that is generally the complement of respective third and fourth guide rails 207*a* and 207*b* at the main frame 200. In a simple embodiment, the support surface 103 can be established by a bottom plate integrated with the first and second guide rails 102*a*, 102*b*, but preferably, the support surface is formed by a bottom plate integrated with the first and second guide rails, and provided with end tongues 104, 105 at rear and forward end of the belt module, in order to establish a recess for reception of a damping plate 106, a damping coating 106*a*, and a sliding plate 107, which includes a sliding coating 108 on its upper surface, located on top of the damping coating 106*a* for supporting the belt (not shown) and establish a sliding face therefore during operation. The bottom plate can thus, advantageously, be provided with a plurality of recesses or holes in order to lower the weight of the structure. The damping plate 106 is formed by an elastic material, for example neoprene, and is arranged for establishing the desired hardness in the base for the runner during operation of the treadmill. This damping coating 106*a* can be changed as needed, in order to achieve different degree of hardness in the running base for the runner. At the rear end of the belt module is supported a turn roller 101 for the belt, and is in each end supported freely rotatable in the end of the first and second guide rails 102*a*, 102*b* with shaft journals 101*a*, 101*b* supported in cuts in the sides of the belt module, formed, for example, as the guide rail 304*a* and 304*b* in FIG. 4*b* for the drive roller 301. The turn roller 101 is adjustable in the longitudinal direction of the belt module 100, by means of adjustment screws 110*a*, 110*b*, or similar means.

FIG. 4*a* shows the drive unit 300 viewed from above, where only parts of the structure is depicted in the drawing. The drive roller is indicated by 301, and is supported in the side edges of the drive unit, through shaft journals 301*a*, 301*b* which are supported in grooves 304*a*. The drive roller 301 is operationally connected to a motor 303 through a drive belt 308. As is clear from FIG. 1 and 4*b*, the drive unit further comprises a per se known raising rod 310*a*, 310*b*, whose lower end is provided with a wheel 315 for adjusting the treadmill vertically and ease movement along the base, respectively. The motor for raising and lowering of the drive unit 300 above the base is indicated with 304 in FIG. 4*b*.

When the belt organ shall be changed, the tensile force on the belt organ is unloaded by means of the adjustment screws 110*a*, 110*b* in the rear edge of the treadmill, after which the drive roller 301 is lifted out of its supporting grooves through a recess 204 in the forward part of the main frame 200. The belt module 100 cane thus be drawn out as a unit from the main frame 200, whereby the belt organ easily can be replaced with a new one; alternatively for replacement of the damping plate 106. Mounting is done in opposite order.

The treadmill can also comprise per se known regulators and display organs, in order to allow regulation of the rotational speed for the belt organ, angle of inclination for the mill, display of the speed of the runner, accumulated time, etc.

The invention presents an improved structure by a treadmill, which gives a substantial simplification of replacements of belt organs and other components, such as damping plate, the same time as the total structure will be more solid than known devices.

What is claimed is:

1. Treadmill for use at running and training, comprising a belt organ endlessly catenated around a drive roller (301) and a turn roller (101), the drive roller is connected to a drive organ (303) in the form of an electric motor, arranged by a drive unit (300) of the treadmill, optional organ (304, 310*a*, 310*b*, 311, 315) in order to raise and lower the treadmill vertically, a damping plate (106) for supporting the belt organ and reduce friction there between during running of the belt organ, characterized by i) a drive unit (300) comprising a carrying frame provided with said drive organ (303) for operation of the belt organ, and optional organ (304, 310*a*, 310*b*, 311, 315) in order to raise and lower the treadmill vertically with respect to the floor, ii) a main frame (200) comprising a first side frame (201*a*) and a second side frame (201*b*) extending substantially along the length of the treadmill and mutually parallel for establishing the outer limitation of the treadmill, whereas the side frames are connected with two or more tie bars (205, 206) for stiffening the main frame, and each of the side frames (201*a*, 201*b*) establishes a third and a fourth guide rail (207*a*, 207*b*) inside the main frame (200) hidden by the side frames, iii) a belt module (100) comprising a supporting surface (106) for supporting the belt organ and establish sliding surfaces therefore during operation, and a first and second guide rail (102*a*, 102*b*) arranged by each side of the damping plate (103) and parallel with each other, in which the first and second guide rails (102*a*, 102*b*) are formed generally complementary with the third and fourth guide rails (207*a*, 207*b*), respectively, in the main frame (200), so that the belt module (100) can be pushed in and out, of the main frame (200) when the belt organ is periodically replaced.

2. Treadmill according to claim 1, characterized by the drive unit (300) is fixed mounted to the main frame (200).

3. Treadmill according to claim 1, characterized by the supporting surface (103) comprising a bottom plate integrated with the guide rails (102*a*, 102*b*) and provided with a first and second end tongue (104, 105) in each end of the damping plate, a damping coating (106*a*) located on top of the damping plate, and a sliding plate (107) provided with a sliding coating on its upper surface.

4. Treadmill according to claim 1, characterized by the damping plate (106) is formed of neoprene.

5. Treadmill according to claim 1, characterized by each of the third and fourth guide rails (207*a*, 207*b*) of the main frame (200) is provided with a coating (208) having a low friction in order to ease the running in and out of the belt module (100) in the main frame (200).

6. Treadmill according to claim 2, characterized by the supporting surface (103) comprising: a bottom plate integrated with the guide rails (102*a*, 102*b*) and provided with a first and second end tongue (104, 105) in each end of the bottom plate, a damping coating (106*a*) located on top of the bottom plate, and, a sliding plate (107) having a sliding coating on its upper surface disposed on top of the damping plate.

7. Treadmill according to claim 2 characterized by the damping plate being formed of neoprene.

8. Treadmill according to claim 3 characterized by the damping plate being formed of neoprene.

9. Treadmill according to claim 2, characterized by each of the third and fourth guide rails (207*a*, 207*b*) of the main frame (200) being provided with a low friction coating (208) in order to ease the running in and out of the belt module (100) in the main frame (200).

10. Treadmill according to claim 3, characterized by each of the third and fourth guide rails (207*a*, 207*b*) of the main frame (200) being provided with a low friction coating (208) in order to ease the running in and out of the belt module (100) in the main frame (200).

11. Treadmill according to claim 4, characterized by each of the third and fourth guide rails (207*a*, 207*b*) of the main frame (200) being provided with a low friction coating (208) in order to ease the running in and out of the belt module (100) in the main frame (200).

* * * * *